US005417375A

United States Patent [19]

Peterson et al.

[11] Patent Number: 5,417,375

[45] Date of Patent: May 23, 1995

[54] MATERIAL REDUCING MACHINE

[75] Inventors: Arnold N. Peterson, Eugene; Larry A. Sprague, Pleasant Hill, both of Oreg.

[73] Assignee: Peterson Pacific Corporation, Eugene, Oreg.

[21] Appl. No.: 199,080

[22] Filed: Feb. 22, 1994

[51] Int. Cl.[6] ..... B02C 18/22

[52] U.S. Cl. ..... 241/35; 241/101.7; 241/185.5; 241/224

[58] Field of Search ..... 241/35, 185.5, 222, 241/224, 101.7

[56] References Cited

U.S. PATENT DOCUMENTS

| | | | |
|---|---|---|---|
| 3,643,873 | 2/1972 | George | 241/3 |
| 4,088,273 | 5/1978 | Jakobs | 241/35 |
| 4,515,318 | 5/1985 | Savonjousi | 241/28 |

FOREIGN PATENT DOCUMENTS

0419919A1 4/1991 Germany .

OTHER PUBLICATIONS

Copy of brochure Vortex, Northfab Systems, Inc. (no date).

*Primary Examiner*—John Husar

*Attorney, Agent, or Firm*—Robert L. Harrington

[57] ABSTRACT

An improved arrangement for feeding material through a material reducing machine. An inclined wall is positioned strategic to a material reduction unit and a plunger of the machine. A lower beveled edge of the inclined wall is positioned in close proximity to the material reduction unit and above the plunger. The plunger forces material toward the material reduction unit and the inclined wall. Material that is below the lower edge of the wall will be forced into the material reduction unit and material that is above the lower edge will be forced to elevate on the inclined wall thus preventing jamming of the forced feed mechanism of the machine. Controls are provided to control the rate of movement of the plunger in correspondence with the rotational rate of the material reduction unit. The rate at which the plunger moves toward the material reduction unit is decreased when the rotational rate of the material reduction unit decreases.

13 Claims, 3 Drawing Sheets

10
12
14
16
18
20
22
24
26
27
28
30
32
34
40
41
42
43
44
45
46
50
52
53
54
60
64
66
68
69
70
72
2A

MATERIAL REDUCING MACHINE

FIELD OF THE INVENTION

This invention relates to machines arranged to reduce material into smaller particles and particularly relates to an improved arrangement for feeding material through the machine so as to alleviate jamming.

BACKGROUND INFORMATION

Material is ground up or otherwise reduced to a smaller particle size for a variety of reasons. Some typical reasons are; material is reduced in size so that it may be recycled to produce other products, material is reduced in size for ease in transportation and disposal, and material is reduced in size to convert what would otherwise be considered scrap material into usable goods.

Machines have been developed to grind or otherwise reduce the material in size. The machines contemplated herein have an apparatus, such as a grinder, a hammer mill or similar device, to reduce the material to a smaller size. The apparatus to reduce the material to a smaller size is often referred to as a hog. The apparatus is believed to be referred to as a hog since it will consume (i.e. reduce) almost all types of material fed into it. The machine has a hopper into which the material to be reduced or ground up is fed. A plunger movable along the base of the hopper forces the material received in the hopper into the material reducing unit (hog) of the machine where the material is reduced in size and discharged from the machine. The machines are intended to handle a wide variation of materials. The variation not only applies to the type of material but also includes the wide variation in the size of the objects to be reduced. It will be appreciated that an object to be reduced may be composed of more than one type of material, either in its composition or as an assembly. Whatever the configuration, the machines are intended to reduce the objects to smaller sized particles.

The wide variation of the objects fed into the machine, both as to the type of material and material size often will lead to a jamming of the feed mechanism or result in the hog becoming overloaded. Small sized objects that fit readily in the hopper may be presented to the hog at too fast a rate. The plunger which feeds the material into the hog may at times force the material into the hog at a much too rapid rate resulting in a slow down or even stalling of the hog. Further, a large object such as a large log or stump for example, may be of a size so that it may be placed in the hopper, but it may be too large in size to feed through the hog of the machine. The large object will often become jammed between the plunger and the frame surrounding the hog. The large object often must be removed from the machine or at least be repositioned before it and other material may be fed through. In addition to removing the large object from the machine, the large object often has to be reduced in size by other means before it is placed back into the material reduction machine. The production rate of the machine is reduced when it becomes jammed with material.

A machine is required that will not be subject to jamming or stoppage from the feeding of material.

BRIEF SUMMARY OF THE INVENTION

The present invention is an improved material reducing machine. The present invention has a feeding mechanism that is not subject to jamming by materials, large or small.

A preferred embodiment of the present invention is a machine with an improved hopper configuration. The hopper is strategically positioned with one wall of the hopper placed in close proximity to the hog of the machine and inclined at an angle with respect to a forced feed path of the material.

A plunger positioned at the base of the hopper forces material into the hog. The plunger has a controlled feed rate and will respond to the rate of rotation of the hog. In one embodiment, if the hog rotation slows down due to an overloading condition, the plunger feed rate reduces accordingly. In a second embodiment, the plunger is simply stopped when the hog rotation reduces to a minimum rate and then restarts when the hog returns to a desired rate. The plunger has a rapid return for reloading with material.

Another embodiment has two plungers in the hopper, an upper plunger positioned above a lower plunger. The lower plunger forces material to be reduced in size into the hog of the machine. The upper plunger, which operates independent of the lower plunger, forces material residing on top of and above the lower plunger toward the hog end of the machine. This enables a shorter stroke cycle of the lower plunger which increases the output of the material reducing machine.

The inclined end wall has its bottom edge in close proximity to the hog and is positioned strategically to the hog. The end wall is strategically positioned so that larger items which are too large to be fed completely into the hog will be partially reduced as the lower portion engages the hog with the upper portion being ramped up the inclined wall. The unreduced upper portion then falls back into the feed path and as the plunger is recycled, this upper portion is forced into the hog where it will be reduced in size.

Refer now to the drawings and the detailed description for a complete understanding of the invention.

DESCRIPTION OF THE PREFERRED EMBODIMENT

Figures 1, 2, 2A, 3:
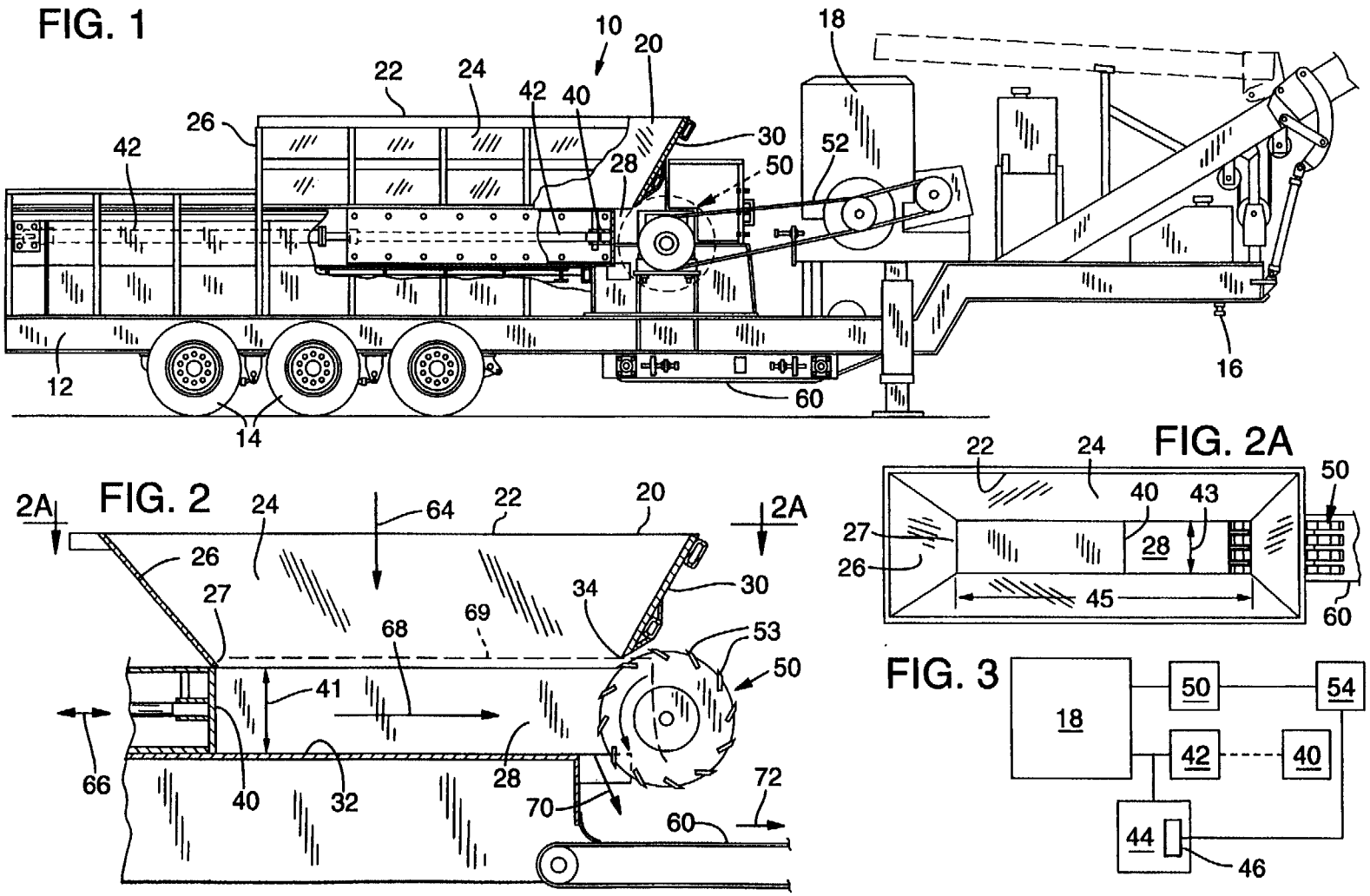
FIG. 1 is a side view of a material reducing machine of the present invention.
FIG. 2 is a schematic view of the material feed path of the machine of FIG. 1.
FIG. 2A is a schematic top view as viewed on view lines 2A—2A of FIG. 2.
FIG. 3 is a schematic view of a power unit of the machine of FIG. 1.

Refer now to FIG. 1 of the drawings which illustrates a material reducing machine 10 of the present invention. The machine 10 is arranged to reduce material to a smaller size, such as, for example, reducing wood logs to wood chips. The machine 10 is a mobile unit having a chassis 12 mounted on transport wheels 14. A hitch 16 is provided for connecting the machine 10 to a towing unit such as a conventional tractor. A power unit 18 is provided to supply power to the machine 10. The power unit 18 includes for example a diesel engine, hydraulic pumps, fuel and hydraulic storage tanks, controls and ancillary equipment normally associated therewith. A hopper 20 is mounted on the chassis 12 for receiving material to be reduced. The hopper 20 has a rectangular opening 22 at its top with the side walls 24 and end walls 26, 30 inclined inwardly toward a lower rectangular portion 28. A plunger 40 is positioned at the base 32 (bottom) of the lower rectangular portion 28 of the hopper 20 and extends across the full width of the rectangular portion as seen in FIG. 2A. The plunger 40 is reciprocally moveable along the length of the hopper bottom 32 by a cylinder 42. A material reducing unit 50, which will hereafter be referred to as a hog 50 is mounted on the chassis 12 with the inclined end 30 of hopper 20 being strategically positioned in relation to the hog 50. The hog 50 is of known design and in this embodiment is a cylindrical drum type rotary holder unit with cutters 53 mounted on its periphery (see FIG. 2). The hog 50 extends across the width of the base 32 of the hopper 20. The hog 50 is rotatably mounted on the chassis 12 and is driven by the power unit 18 via conventional power transmitting devices such as belts 52. A conveyor 60 is provided on the chassis 12 and is positioned below the hog 50. The conveyor 60 will convey the material reduced by the hog away from the machine 10.

Material to be reduced in size is fed through the opening 22 of the hopper 20 of the machine 10. The material is fed into the hopper by conventional equipment, such as front end loaders, grapples, other conveyors and the like. Material received in the hopper 20 is forced by the plunger 40 into the hog 50. The cutters of the rotating hog 50 will reduce the material to smaller pieces. The smaller pieces drop down through a sizing grate onto the conveyor 60 and are conveyed away from the machine 10. Larger pieces are carried over the hog and further reduced until the grate openings will accept the pieces. The grates are typically replaceable with grates having different sized openings as desired for a particular application.

The machine 10 has a material feed path which is schematically illustrated in FIG. 2. The plunger 40 has been retracted away from the hog 50 as shown. The plunger 40 is movable as indicated by the bi-directional arrow 66. The material is fed into the hopper 20 as indicated by arrow 64. The amount of material received in the hopper can vary and a major benefit is that the operator does not have to be concerned with the quantity or the timing. Material deposited into the hopper while the plunger is partially or fully extended into the hopper will be supported on the top of the plunger until retraction whereupon the rear hopper wall 26 being in close proximity to the plunger will wipe the material off the plunger and the material will fall onto the base 32 of the hopper. The lower end portion of wall 26, designated generally by numeral 27 in FIGS. 2 and 2A, acts as a wiper blade to wipe the material off the plunger. The bottom portion of the material deposited into the hopper 20 (with the plunger retracted) resides within the section of the hopper through which the plunger 40 operates (this section is designated by arrow 41 in FIG. 2 and by arrows 43 and 45 in FIG. 2A). The plunger 40 is advanced toward the hog 50 thus forcing the material in the path of the plunger 40 to move into the hog 50 as indicated by the directional arrow 68. The portion of the feed path designated by arrow 68 can be considered the forced feed path of the machine 10. The forced feed path 68 is generally bounded (as indicated by the dashed lines 69) by the sides of the lower portion 28 and the bottom 32 of the hopper 20 with the upper reaches being generally at the height at which the lower portion 34 of the end wall 30 is positioned above the base 32 of the hopper 20. It will be appreciated that material that is being forced toward the hog by the plunger 40 may extend above the upper bounds of the feed path. It will also be appreciated that the forced feed path 68 extends into and through the hog 50. The material is forced into the hog 50 where it is reduced to smaller pieces with the pieces falling onto the conveyor 60 as indicated by arrow 70. The material received on the conveyor 60 is conveyed away from the machine 10 as indicated by arrow 72. The plunger 40 is cycled as required to feed all of the material through the hog 50.

Refer now to FIG. 3 of the drawings. The machine 10 as previously mentioned is powered by the power unit 18. The power unit 18 provides rotative power to the hog 50 and provides fluid power to the cylinder 42 to affect movement of the plunger 40. Controls 44, coupled to the power unit 18 and the cylinder 42 in a conventional manner, are provided to facilitate controlling the movement of the plunger 40. The controls 44 control the advancement of the plunger 40 toward the hog 50 and the retraction of the plunger 40 away from the hog 50. The plunger 40 is controlled by the control 44 to advance toward the hog 50 at variable rates. The rate of movement of the plunger 40 toward the hog 50 is dependent in part on the type of material to be reduced. Some materials are much more difficult to reduce to smaller sizes and therefore requires much more power. The power required may in many cases cause a dramatic reduction in the rotational rate or may even cause stoppage of the hog 50. The rate of movement of the plunger 40 is thus coupled to the rate of rotation of the hog 50.

When the rate of rotation of the hog 50 decreases due to a heavy load for example, the rate at which the plunger 40 moves toward the hog 50 is decreased. A monitor 54 is provided to monitor the rate of movement, that is the rate of rotation of the hog 50. The monitor 54 is coupled to a variable rate control device 46 of the control 44. The rate at which the plunger 40 advances toward the hog 50 is initially set at an optimum rate based on known parameters such as material size, type of material and so forth. The variable rate control device 46 will alter the rate at which the plunger 40 advances toward the hog 50 based on the rotational rate of the hog 50. The variable rate device 46 will slow the rate at which the plunger 40 advances toward the hog 50 when the rotational rate of the hog 50 decreases. Similarly, when the rotational rate of the hog increases once again to its normal rate, the variable rate device 46 will increase the feed rate of the plunger 40 to its optimum rate. Should the rate of rotation of the hog 50 decrease below a determined minimum level, the control device 46 will stop the advancement of the plunger 40. A time delay is incorporated in the control device 46 to permit the hog 50 to regain its rotational rate before the plunger 40 is once again advanced. The control device 46 is also arranged to be optionally set to retract the plunger 40 a short distance once the rotational rate of the hog 50 drops below a predetermined level. The control 44 will retract the plunger 40 at a rapid rate once the plunger has been advanced to the limit of its stroke. The plunger 40 may be retracted fully or at any fraction of its return stroke.

It will be appreciated that the rate at which the plunger advances may be varied in many ways. Another form of variable rate control of the plunger is to cycle the plunger through start-stop cycles. As the rotational rate of the hog decreases below a specified rate, the plunger is stopped. When the hog returns to the same or preferably a higher specified rate, the plunger is once again started to advance. The start-stop cycling of the plunger varies the rate at which the plunger is advanced.

Figure 4:
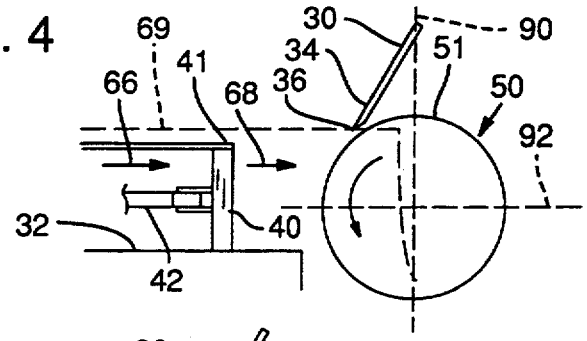
FIG. 4 is a view showing the relation between an inclined wall of a hopper, a hog and a plunger of the machine of FIG. 1.

Refer now to FIG. 4 of the drawings. The hog 50 and the hopper 20 are strategically positioned in relation to each other. As seen in FIGS. 1 and 2, the hog 50 is mounted on the chassis 12 strategic to the hopper 20 with the hog 50 extending into the lower portion 28 of the hopper 20 at the wall end 30. The wall 30 of the hopper 20 is inclined with respect to the hopper base 32 and thus the forced feed path 68 with the lower end 34 of the wall positioned in close proximity to the hog 50. The lower end 34 of the wall 30 has a beveled end 36 that is in close proximity to the rotational path of the cutters 53 of the hog 50 as indicated by the circle 51 (cutters 53 are shown in FIG. 2). The path 51 of the cutters 53 thus intersects the forced feed path 68. The beveled end 36 of the lower end 34 is positioned above the top 41 of the plunger 40 (as viewed in the figure). The lower end 34 of the wall 30 is positioned in the quadrant between 9 and 12 o'clock and as illustrated in the drawings is at approximately forty five degrees (the quadrant defined by the planes 90, 92 with the vertex of the quadrant being the center of rotation of the hog 50) as viewed in FIG. 4. As shown, the wall 30 is inclined and positioned in relation to the rotational path 51 of the cutters in a near tangent manner. The strategic positioning and the angle of inclination of the wall 30 facilitates feeding large material or objects through the hog 50.

Figure 5A:
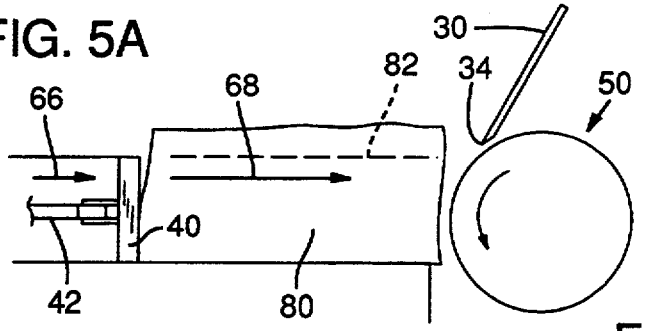
FIG. 5A–5E illustrate a large object being fed into the machine of FIG. 1.
Figure 5B:
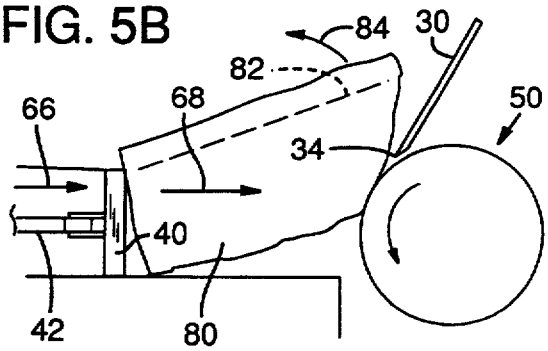
Figure 5C:
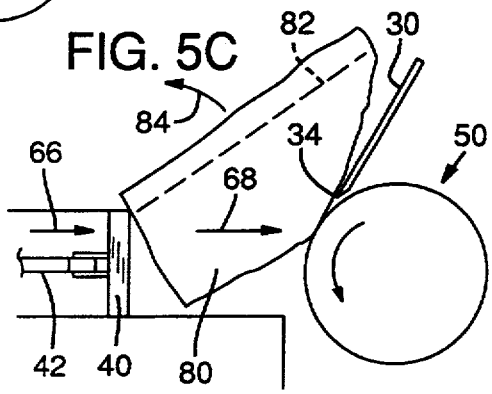
Figure 5D:
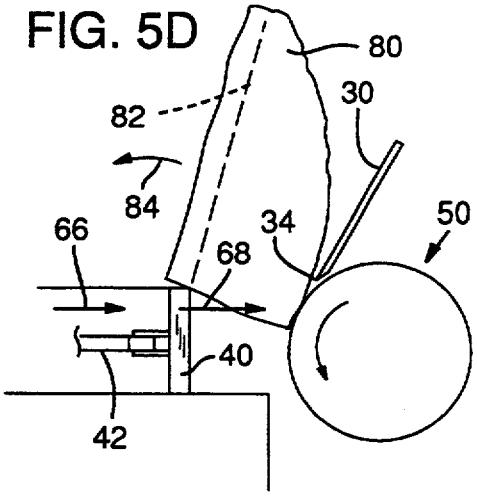
Figure 5E:
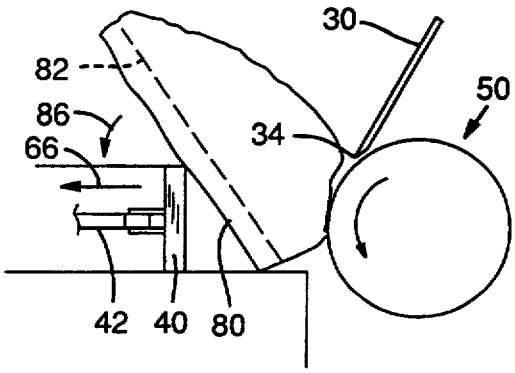

The machine 10 is arranged to feed large bulky objects or materials such as stumps, root balls, large diameter logs and the like without jamming the feed mechanism. FIGS. 5A–5E illustrate a large object 80, such as a log, being fed into the hog 50. Referring to FIG. 5A, the plunger 40 has been retracted and the object 80 is received on the bottom 32 of the hopper 20. As shown in FIG. 5A, the upper portion 82 of the log 80 extends above the lower edge 34 of the inclined wall 30. As the plunger 40 forces the log 80 into the hog 50, the upper portion 82 of the log 80 will contact the lower edge 34 of the wall 30 resulting in the log 80 being forced upwardly on the incline of the wall 30 as indicated in FIG. 5B by arrow 84. FIGS. 5C and 5D illustrate a further progression of the log 80 as the plunger 40 is advanced toward the hog 50. FIG. 5E illustrates the plunger 40 being retracted and the log 80 falling back into the feed path as indicated by arrow 86. The plunger 40 will again be advanced toward the hog 50 to force the log 80 into the hog 50 once again. The lower edge 36, being positioned above the top 41 of the plunger 40 also acts as a point of pivot for material extending upward beyond the lower edge 36. As the material is forced into the hog 50 by the plunger 40, the material contacting the lower edge 36 will be forced to pivot about the lower edge 36 to thus fall back into the forced feed path when the plunger 40 retracts.

Figure 6:
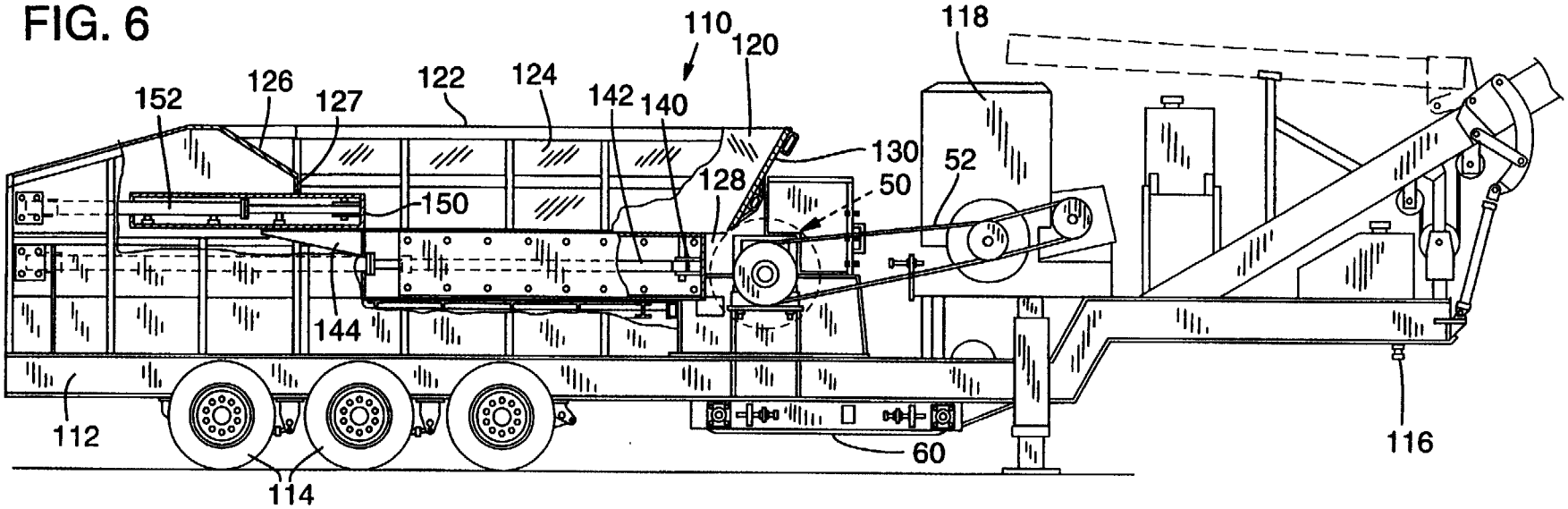
FIG. 6 is a side view of another embodiment of the material reducing machine of the present invention.

FIG. 6 illustrates another embodiment of a material reducing machine 110 of the present invention. The machine 110 is similar to the machine 10 earlier described and illustrated. The machine 110 is a portable unit having a chassis 112 mounted on wheels 114 for portability and has a hitch 116 for connecting the machine to a conventional towing unit (not shown). A power unit 118 mounted on the chassis 112 is provided to supply power to the machine 110. A hopper 120 having a rectangular opening 122 at its top is mounted on the chassis 112 strategic to a hog 50. The hopper 120 has side walls 124, an end wall 126 and an opposite end wall 130. The lower end of wall 126 has a wiper portion 127. The end wall 130 is positioned strategic to the hog 50 in the same manner as wall 30 of the machine 10 previously described. The walls 124, 126 and 130 are inclined inwardly toward a lower rectangular portion 128 of the hopper 120. A lower primary plunger 140 is provided for reciprocal movement along a base 132 (bottom of hopper and of lower rectangular section 128) which defines a primary feed path. The plunger 140 extends across the width of the rectangular section 128. The plunger 140 is reciprocally movable by a cylinder 142.

In this embodiment another auxiliary or secondary plunger 150 is mounted for sliding movement on the lower plunger 140. The plunger 150 is reciprocally movable by a cylinder 152. The plunger 150 is in sliding contact with the plunger 140 as the plunger 140 and/or the plunger 150 are moved except when the plungers 140 and 150 are moving at the same rate in the same direction. The plungers 140 and 150 may be moved independently of each other in either direction and in conjunction with each other in the same direction. An extending support 144 is provided on the lower plunger 140 to support the plunger 150 when the lower plunger is fully extended toward the hog 50 and the plunger 150 is retracted fully toward the inclined end wall 126.

In operation, material is fed into the hopper 120 through the top opening 122. The material will fall by gravity toward the bottom 132 of the hopper. At initial start up, the plungers 140 and 150 are most often fully retracted toward the end wall 126. As soon as sufficient material has been deposited into the hopper the lower plunger 140 is moved toward the end wall 130 and the hog 50. The lower plunger 140 as it is advanced toward the hog 50 will force material that is in front of the plunger 140 (material that is between the plunger 140 and the hog 50) into the hog 50. The hog 50 will reduce the material that is forced into it to a smaller size. As the lower plunger 140 progresses toward the hog 50, the upper plunger 150 is moved toward and away from the end wall 130 as required to force material that is on top of the lower plunger 140 toward the end wall 130. The top portion of the lower plunger 140 when extended into the hopper 120 in effect defines a secondary bottom of the hopper 120. The upper plunger 150 traveling along the secondary bottom defines a secondary feed path. When the lower plunger 140 has reached the end of its stroke or a pre-determined stroke length in its travel toward the hog 50, the lower plunger 140 is retracted so that the additional material that has been forced by the upper plunger 150 toward wall 130 will fall between the end of the lower plunger 140 and the hog 50. The upper plunger 150 has forced material toward the end wall 130 and therefore the lower plunger 140 need be retracted only a distance sufficient to permit material to fall to the bottom of the hopper between the end of the lower plunger 140 and the hog 50. The utilization of the upper plunger 150 thus shortens the required stroke length of the lower plunger 140.

During the retraction of the lower plunger 140, there is not appreciable material being fed into and through the hog 50. The shorter the length of stroke the lower plunger 140 is retracted, the greater the advantage of increased production.

The upper plunger 150 being independently controlled and cycled greatly enhances moving material toward the end wall 130 so that it will readily drop between the lower plunger 140 and the hog 50 when the lower plunger 140 is retracted. The upper plunger 150 as it is cycled back and forth aids in compressing the material to be reduced and is beneficial in eliminating bridging of material that may occur in the hopper, particularly when long items are fed into the hopper.

Figure 7:
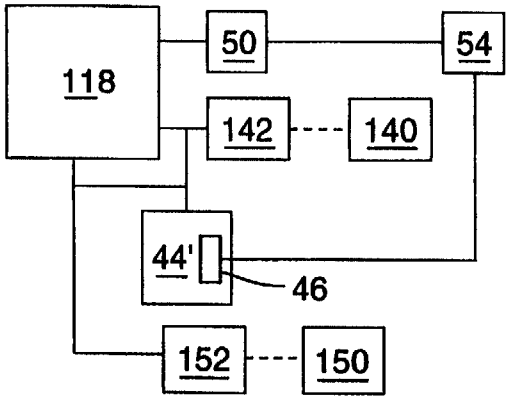
FIG. 7 is a schematic view of the controls used for the embodiment of FIG. 6.

Controls are provided to control the operation of the upper plunger 150, the lower plunger 140, and the hog 50 as illustrated in FIG. 7. The power unit 118 provides power for the hog 50, the upper plunger 150 and the lower plunger 140. Controls 44' are coupled to the power unit 118, the lower plunger cylinder 142 and the upper plunger cylinder 152 in a conventional manner to control the operation of the lower plunger 140 and the upper plunger 150. The controls 44' are arranged to independently control the operation of the lower and upper plungers 140, 150. The upper plunger 150 may thus be advanced and retracted at any desired stroke length within its range independent of the lower plunger 140. The lower plunger 140 is controlled by the controls 44' in conjunction with the monitor 54 and the variable rate control 46 as previously explained (in reference to FIG. 3) for the lower plunger 40 of the machine 10.

It will be apparent to those skilled in the art that modifications and variations may be made without departing from the true spirit and scope of the invention. The invention is therefore not to be limited to the embodiments described and illustrated but is to be determined from the appended claims.

What is claimed is:

1. A material reduction machine, comprising:

a chassis;

a hopper mounted on the chassis and having an open top for receiving material to be reduced, a lower portion of said hopper defining a forced feed path;

a plunger movably mounted in the hopper, said plunger movable in the forced feed path for moving material received in the hopper along the forced feed path following and during receiving of material through the open top, said plunger reciprocally movable between a retracted position at a rear end of the hopper and an advanced position at a forward end of the hopper;

a material reduction unit mounted on the chassis with the forced feed path extending into the material reduction unit;

a power unit for reciprocally moving the plunger between the retracted position and the advanced position;

a front end wall of said hopper inclined inwardly toward said lower portion, a lower end of said front end wall positioned above said forced feed path and said material reduction unit defining a curved cutting path having an uppermost position extended at least to the lower end and outwardly of said front end wall, and said lower end of said front end wall in close proximity to said cutting path, whereby said plunger advancing toward said material reduction unit forcibly feeds material received in said hopper toward said cutting path of the material reduction unit and said inclined wall whereat material below said lower end of said inclined wall will be forced into the cutting path of said material reduction unit and material above said lower end of said inclined wall will be forced up the inclined wall.

2. A material reduction machine as defined in claim 1, wherein:

said lower end of said inclined wall is positioned above said plunger and wherein said materials reduction unit is a hog having teeth mounted on the periphery of a rotating holder, the teeth defining a circular cutting path.

3. A material reduction machine as defined in claim 2, wherein:

said lower end of said inclined wall is beveled to permit a close fit of the inclined wall relative to the circular cutting path, said circular cutting path defining an upper plunger-facing quadrant between the horizontal and vertical positions of said cutting teeth, said lower end of said inclined wall positioned at said upper quadrant.

4. A material reduction machine as defined in claim 3 wherein said lower end of the inclined wall is beveled in the direction of the circular cutting path for enhancement of the close fit.

5. A material reduction machine as defined in claim 1, further including:

a control for controlling the movement of said plunger.

6. A material reduction machine as defined in claim 5, wherein:

said control is a variable rate control for controlling the rate of movement of said plunger.

7. A material reduction machine as defined in claim 6, further including:

a monitor for monitoring the rate of movement of said material reduction unit, said monitor coupled to said variable rate control, said variable rate control varying the rate of movement of said plunger corresponding to the rate of movement of said material reduction unit.

8. A material reduction unit as defined in claim 1, wherein:

said hopper includes a defined portion in the bottom of said hopper and within said forced feed path, said plunger positioned in the defined portion and having an upper width and length that extends across the defined portion as the plunger is advanced into the hopper to thereby prevent material from dropping into the defined portion behind the plunger.

9. A material reduction unit as defined in claim 8, wherein:

the rear end wall is in close proximity to the plunger whereby as the plunger is retracted material residing on the plunger is wiped of the plunger to be deposited in the defined portion of the hopper.

10. A material reduction machine as defined in claim 1 wherein said plunger is a primary plunger and said hopper has a length that extends rearwardly of the retracted position of said primary plunger, and including an auxiliary plunger reciprocally mounted above said primary plunger and movable between a forward position at the retracted position of the primary plunger and to a further rearward position in said hopper whereby reciprocal movement of the auxiliary plunger moves material from the rear of the hopper into position at the retracted position of the primary plunger for deposit into the feed path to be subsequently moved along the feed path by the primary plunger into the material reduction unit.

11. A material reduction machine comprising:

a material receiving hopper having a defined length and width and including a top, bottom, front end and rear end, a material reducing unit mounted in the front end for receiving material and a discharge mechanism for discharging the materials reduced by the material reducing machine out of the hopper;

a primary feed path defined at a first bottom position of the hopper and extended from a position intermediate the front end and rear end of the hopper and along the bottom and into the material reducing unit at the front end of the hopper, a primary plunger reciprocally mounted at the first bottom position of the hopper for reciprocal movement along said primary feed path for feeding material deposited into the primary feed path into the material reducing unit; and a secondary feed path defined at a second bottom position of the hopper above the primary feed path and extending from a position at the rearward end of the hopper to the intermediate position, a secondary plunger reciprocally mounted at the second bottom position of the hopper for reciprocal movement along said secondary feed path and into a superimposed position over the primary piston for feeding material deposited in the secondary feed path into the primary feed path upon retraction of the primary plunger to the intermediate position.

12. A material reduction machine as defined in claim 11 comprising:

control means for controlling the reciprocal movement of said primary and secondary plungers, and said primary and secondary plungers cooperatively arranged whereby material lying on top of the primary plunger is wiped off the primary plunger by the secondary plunger upon retraction of the primary plunger to be deposited into the primary feed path.

13. A material reduction machine as defined in claim 12 wherein said rear end position of the hopper includes a wiper blade portion that wipes material from the top of the secondary plunger and into the secondary feed path upon retraction of the secondary plunger to the rear end position.

* * * * *